US011041351B2

(12) United States Patent
Cramer et al.

(10) Patent No.: US 11,041,351 B2
(45) **Date of Patent: *Jun. 22, 2021**

(54) DOWNHOLE FLOW DIVERSION DEVICE WITH OSCILLATION DAMPER

(71) Applicant: Dynomax Drilling Tools USA, Inc., Leduc (CA)

(72) Inventors: David S. Cramer, Okotoks (CA); Michael J. Harvey, Calgary (CA); David D. Devlin, Calgary (CA)

(73) Assignee: Dynomax Drilling Tools Inc. (Canada), Leduc (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/730,592

(22) Filed: Dec. 30, 2019

(65) Prior Publication Data

US 2020/0131871 A1 Apr. 30, 2020

Related U.S. Application Data

(63) Continuation of application No. 15/553,100, filed as application No. PCT/CA2015/051244 on Nov. 30, 2015, now Pat. No. 10,544,637.

(Continued)

(51) Int. Cl.

| | |
|---|---|
| ***E21B 21/10*** | (2006.01) |
| ***E21B 4/02*** | (2006.01) |
| ***E21B 34/08*** | (2006.01) |

(52) U.S. Cl.

CPC ..... *E21B 21/103* (2013.01); *E21B 4/02* (2013.01); *E21B 34/08* (2013.01); *E21B 2200/06* (2020.05)

(58) Field of Classification Search

CPC ..... E21B 21/103; E21B 2200/06; E21B 4/02; E21B 34/08; E21B 2034/007

(Continued)

(56) References Cited

U.S. PATENT DOCUMENTS

| | | | |
|---|---|---|---|
| 3,454,089 | A | 7/1969 | Brown |
| 3,826,993 | A | 7/1974 | White |

(Continued)

FOREIGN PATENT DOCUMENTS

| | | | |
|---|---|---|---|
| AU | 2007257708 | A1 | 12/2007 |
| CN | 101787858 | A | 7/2010 |

(Continued)

OTHER PUBLICATIONS

International Search Report for International Application No. PCT/CA2015/051244, dated Dec. 24, 2015 (3 pages).

*Primary Examiner* — Taras P Bemko

(57) ABSTRACT

A device for limiting the flow of drilling fluid through a section of drill string is described. The device includes a cylindrical tube with holes in its periphery. Flow enters the device through an upper end of the tube and a portion of the flow exits through the lower end of the tube. In addition, some of the flow is diverted through the peripheral holes. A valve piston is supported near the lower end of the tube by a spring of approximately constant force through its range of travel. The valve piston moves axially as the flow rate through the tube changes flow rate to ensure that a substantially constant amount of flow exits through the lower end, while the excess flow is diverted from the tube through the peripheral holes. A means of damping or stopping the axial movement of the valve piston is included in the device.

17 Claims, 11 Drawing Sheets

Related U.S. Application Data

(60) Provisional application No. 62/119,712, filed on Feb. 23, 2015.

(58) Field of Classification Search
USPC ..... 166/320
See application file for complete search history.

(56) References Cited

U.S. PATENT DOCUMENTS

| | | | |
|---|---|---|---|
| 4,055,338 | A | 10/1977 | Dyer |
| 4,508,174 | A | 4/1985 | Skinner |
| 4,645,007 | A | 2/1987 | Soderberg |
| 4,768,598 | A | 9/1988 | Reinhardt |
| 4,856,756 | A | 8/1989 | Combs |
| 5,003,834 | A | 4/1991 | Muller et al. |
| 5,479,988 | A | 1/1996 | Appleton |
| 5,873,416 | A | 2/1999 | Horton, III |
| 6,003,834 | A | 12/1999 | Read |
| 6,263,969 | B1 | 7/2001 | Stoesz et al. |
| 6,325,151 | B1 | 12/2001 | Vincent et al. |
| 6,328,112 | B1 | 12/2001 | Malone |
| 6,550,541 | B2 | 4/2003 | Patel |
| 7,523,792 | B2 | 4/2009 | El-Rayes et al. |
| 7,757,781 | B2 | 7/2010 | Hay et al. |
| 7,845,416 | B2 | 12/2010 | Turner et al. |
| 8,087,476 | B2 | 1/2012 | Wassell et al. |
| 8,194,667 | B2 | 6/2012 | Belgaied et al. |
| 8,323,115 | B2 | 12/2012 | Hocking |
| 8,826,993 | B2 | 9/2014 | Guidry et al. |
| 9,328,576 | B2 | 5/2016 | Cramer et al. |
| 10,107,073 | B2 | 10/2018 | Cramer et al. |
| 2001/0001429 | A1 | 5/2001 | Webb |
| 2004/0055743 | A1 | 3/2004 | Vann |
| 2004/0256113 | A1 | 12/2004 | LoGiudice et al. |
| 2009/0031784 | A1 | 2/2009 | Koda et al. |
| 2009/0056952 | A1 | 3/2009 | Churchill |
| 2010/0224410 | A1* | 9/2010 | Wassell ..... E21B 17/07 175/40 |
| 2011/0036631 | A1 | 2/2011 | Prill et al. |
| 2011/0155379 | A1 | 6/2011 | Bailey et al. |
| 2011/0240300 | A1 | 10/2011 | Cenac |
| 2012/0247832 | A1 | 10/2012 | Cramer et al. |
| 2013/0056283 | A1 | 3/2013 | Wassell et al. |
| 2013/0062124 | A1 | 3/2013 | Roders et al. |
| 2013/0168092 | A1 | 7/2013 | Evans |
| 2014/0020955 | A1 | 1/2014 | Cramer et al. |
| 2019/0169960 | A1 | 6/2019 | Cramer et al. |

FOREIGN PATENT DOCUMENTS

| | | | |
|---|---|---|---|
| CN | 202165053 | U | 3/2012 |
| WO | 2007/146889 | A3 | 12/2007 |
| WO | 2013/122987 | A1 | 8/2013 |

* cited by examiner

DOWNHOLE FLOW DIVERSION DEVICE WITH OSCILLATION DAMPER

CROSS-REFERENCE TO RELATED APPLICATIONS

This application is a continuation of U.S. patent application Ser. No. 15/553,100 entitled "DOWNHOLE FLOW DIVERSION DEVICE WITH OSCILLATION DAMPER" and having a 371(c) date of Aug. 23, 2017, which is a national entry of PCT Application No. PCT/CA2015/051244 filed Nov. 30, 2015, which application claims benefit under 35 U.S.C. § 119(e) to U.S. Provisional Patent Application No. 62/119,712, filed Feb. 23, 2015, each of which applications is assigned to the current assignee hereof and incorporated herein by reference in its entirety.

BACKGROUND OF THE INVENTION

Field of the Disclosure

The present invention relates in general to drill strings and, in particular, to a system, method and apparatus for regulating fluid flow through a drill string.

Description of the Related Art

A conventional means of drilling for oil or gas includes pumping drilling fluid through a pipe or drill string to a drill bit that is cutting the hole in the rock. The fluid is circulated back up though wellbore in the annular or outer section of the hole. Drilling fluid is beneficial to the drilling process since it clears away pieces of rock that have been cut from the bottom of the wellbore. Without this cleaning action the cut pieces of rock would accumulate near the drill bit and it would become impossible to drill the hole. In general, the higher the level of fluid flow that a drilling operation can achieve, the better that cut pieces of rock or "cuttings" are cleared from the bottom of the wellbore.

However, there are several factors that limit the amount of fluid flow, such as the amount of pressure that it takes to pump a large amount of fluid. As the drill string becomes longer or narrower pumping a given amount of fluid encounters more and more resistance and therefore a high amount of pressure is required. With any fluid pump set up there is always a limit to the amount of pressure that can be overcome in order to make the fluid flow, so the size or type of pump that is available on drilling rate can limit the available flow rate. Another limiting factor is the capability of the downhole mud motor. Mud motors are used to make the rock cutting drill bit spin faster than the drill pipe that it is connected to. This is important in cases where a drilling operator may want to drill while holding the drill string still or may want to spin the drill bit faster in general to achieve a higher rate of penetration into the rock. The mud motor works in a fashion similar to a turbine in that mud that flows through the motor turns a rotor which is connected to the drill bit. Energy from the flow in the form of pressure is converted into rotation all work that the drill bit does. These mud motors are designed such that there is a maximum amount of flow that the motors are designed to handle. Forcing more fluid through the motor then it is designed for will result in damage to the motor and will inhibit the drilling process.

The desire to flow a high volume of drilling fluid through the well and the need to limit the volume flow rate due to the constraints of the motor are often conflicting. It would be desirable to slow as much fluid as is desired while ensuring that the motor did not experience a rate of flow higher than its design criteria. Thus, improvements in controlling drill string fluid flow continue to be of interest.

SUMMARY

Embodiments of a system, method and apparatus for controlling fluid flow through a drill string are disclosed. For example, an apparatus may include a housing having an axis, a radial wall with a bore extending axially therethrough, and an aperture formed in the radial wall. The aperture is in fluid communication with the bore. A piston may be located inside the housing and have an orifice configured to permit axial fluid flow through the housing. A spring may be located in the housing and be configured to axially bias the piston to a closed position. A viscous damper can dampen axial motion of the piston.

In other embodiments, a method of controlling fluid flow through a drill string may include operating the drill string to drill a hole in an earthen formation; pumping fluid through the drill string to a mud motor such that substantially all of the fluid is flows axially to the mud motor and substantially none of the fluid is radially diverted out of the drill string; and then increasing a flow rate of the fluid such that some of the fluid is radially diverted out of the drill string by a valve before reaching the mud motor, and a remainder of the fluid is flows axially to the mud motor. A viscous damper can dampen motion of the valve in both axial directions.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
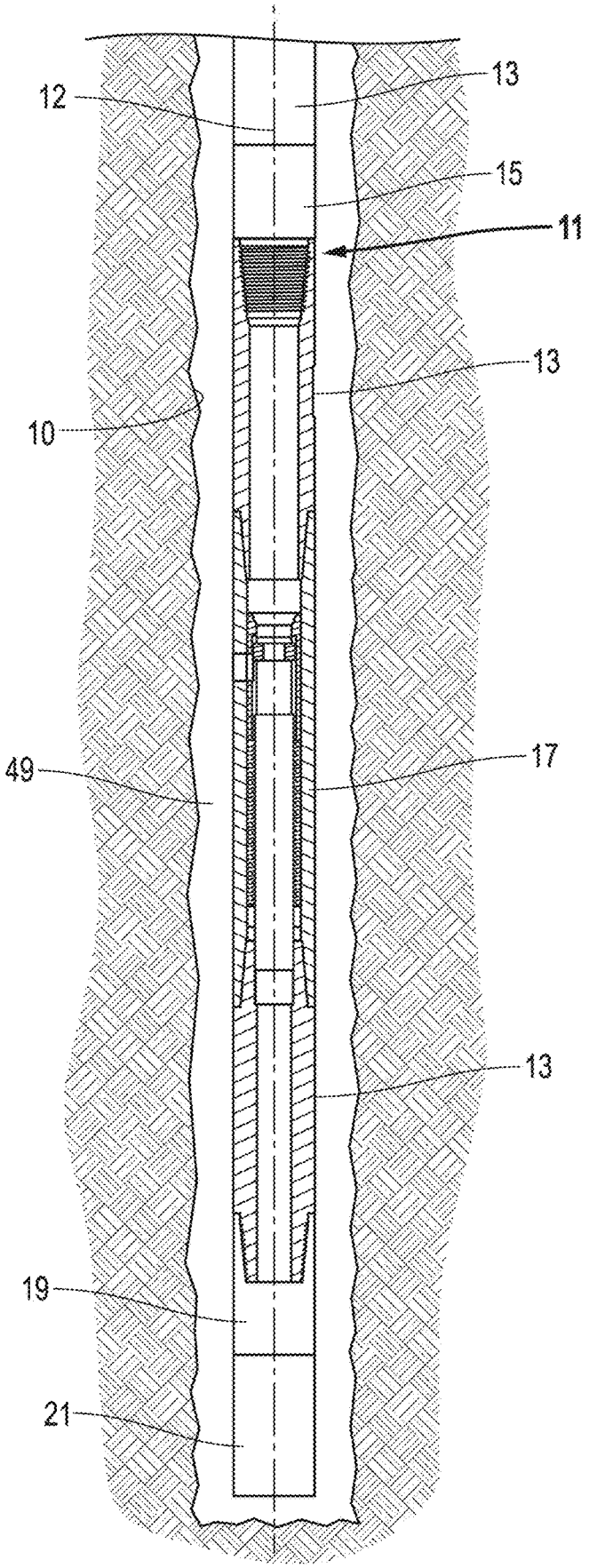
FIG. 1 is a sectional side view of an embodiment of drill string assembly.

Drill string fluid flow may be better controlled with radial ports in the drill string above the mud motor. By choosing the size of the ports carefully, the amount of flow that exits through the ports and the amount of flow that continues on through the drill string into the mud motor can be controlled. The amount of fluid that exits through the ports will vary depending on the back pressure from the mud motor. The back pressure from the mud motor is a factor of how much torque it delivers, so the more torque that is needed or generated by the motor, the higher the back pressure from the motor, and more fluid is radially diverted out of the drill string. The more fluid that is radially diverted out of the drill string, the less fluid that is delivered to the motor. When less fluid goes through the motor the amount of torque that the motor can generate falls, and so a situation can develop where the motor stalls and needs more torque to overcome its boundary condition, which results in less available flow to generate the necessary power. Conversely, an off-bottom situation where there is relatively low amounts of back pressure generated by the motor because there is low or no drilling torque results in a high amount of fluid passing through the motor and a low amount of fluid exiting the drill string. This is problematic because a low torque situation causes the motor to spin faster at a given flow rate and increased amounts of flow will only exacerbate this situation.

Some motor manufacturers attempt to solve this problem by drilling a hole through the rotor of the motor so that fluids may still pass through the tool without generating torque or causing damage to the motor. Unfortunately, such rotor holes are static and cannot change shape to adjust for differing flow or pressure conditions. Thus, that solution is subject to the same limitations as the prior art.

One possible means to solve this problem is with a tool that varies the size of the outlet orifice depending on flow and back pressure that is used to drill the well, as will be described herein. A variable outlet valve (described below) compensates for abrupt changes in the drilling conditions that can cause the valve piston to move quickly and its mass and momentum may cause it to overshoot the location where it needs to settle upon. In these situations the valve may begin to oscillate and flow may need to be stopped in order to bring the valve to a stable state. This type of oscillatory behavior is rare but can occur if the valve is being used in a position or flow rate where it is just marginally opened. In those cases a small axial movement of the valve piston can represent a relatively large difference in outlet nozzle flow area (i.e., while transitioning from fully closed to somewhat open in a short span of time). Because of this potential for the piston to overshoot and become unstable, it is desirable to include some means of limiting the movement of the piston so that it can more consistently rest in a stable position.

Embodiments of a system, method and apparatus for enhanced control of fluid flow through a drill string are disclosed. For example, FIG. 1 depicts an embodiment of a downhole tool assembly 11 for drilling a well bore 10. The downhole tool assembly 11 may comprise a variety of configurations. In one embodiment, the downhole tool assembly 11 may include an axis 12, a plurality of drill pipes 13, measurement while drilling (MWD) equipment 15, a fluid flow control tool 17, a mud motor 19 and a drill bit 21. The order or sequence of these components may be varied depending on the application. For example, the MWD equipment 15 may be located above or uphole from the drill bit 21. In some embodiments, the MWD equipment 15 may be axially relatively close (e.g., within about 100 meters) to the drill bit 21. Likewise, the MWD equipment 15 may be located above but axially relatively close to fluid flow control tool 17, such that fluid flow control tool 17 is relatively close to the drill bit 21 as well.

Figure 2:
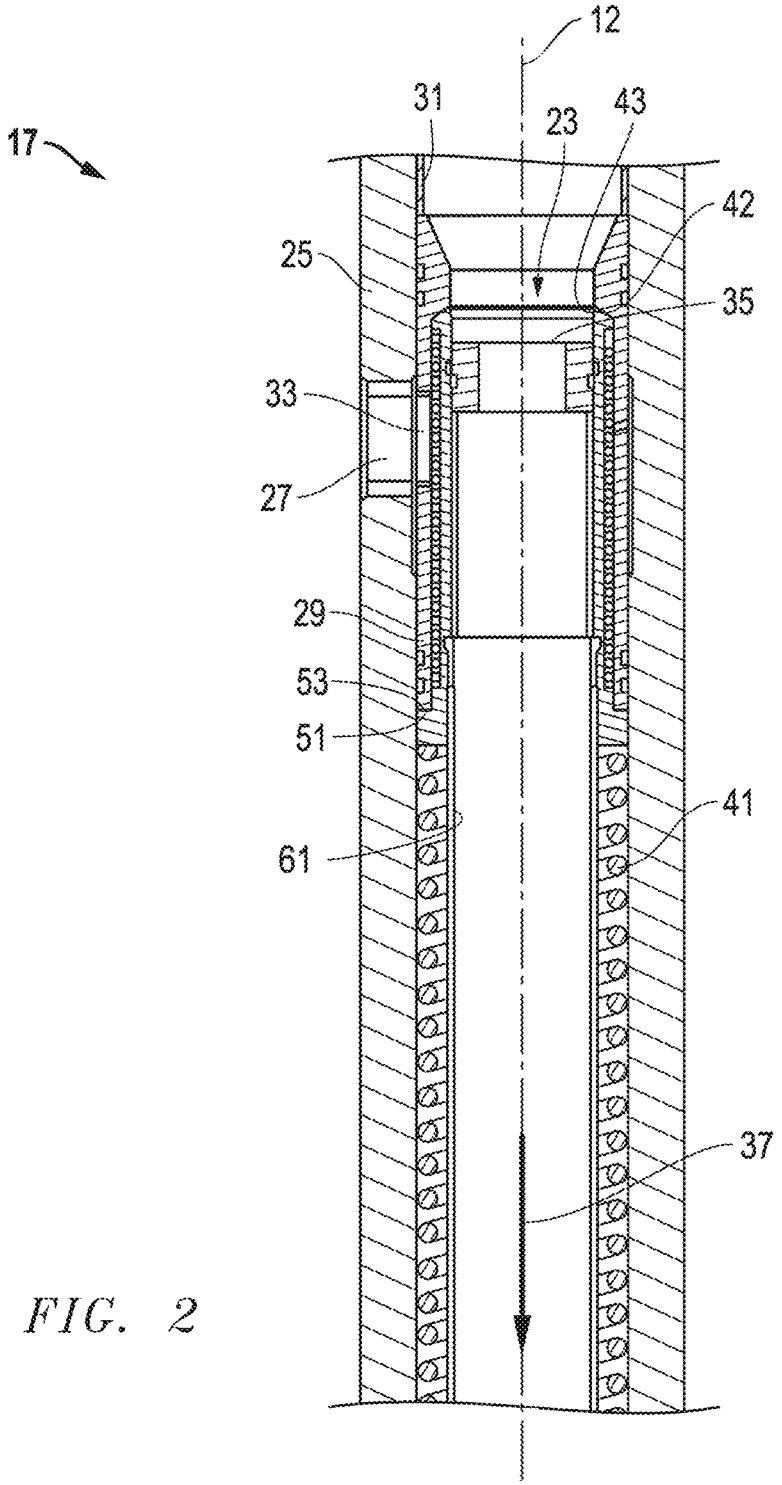
FIGS. 2-4 are sectional side views of an embodiment of a system, method and apparatus for limiting fluid flow through a drill string, illustrating a closed position, a partially open position, and a fully open position, respectively.
Figure 3:
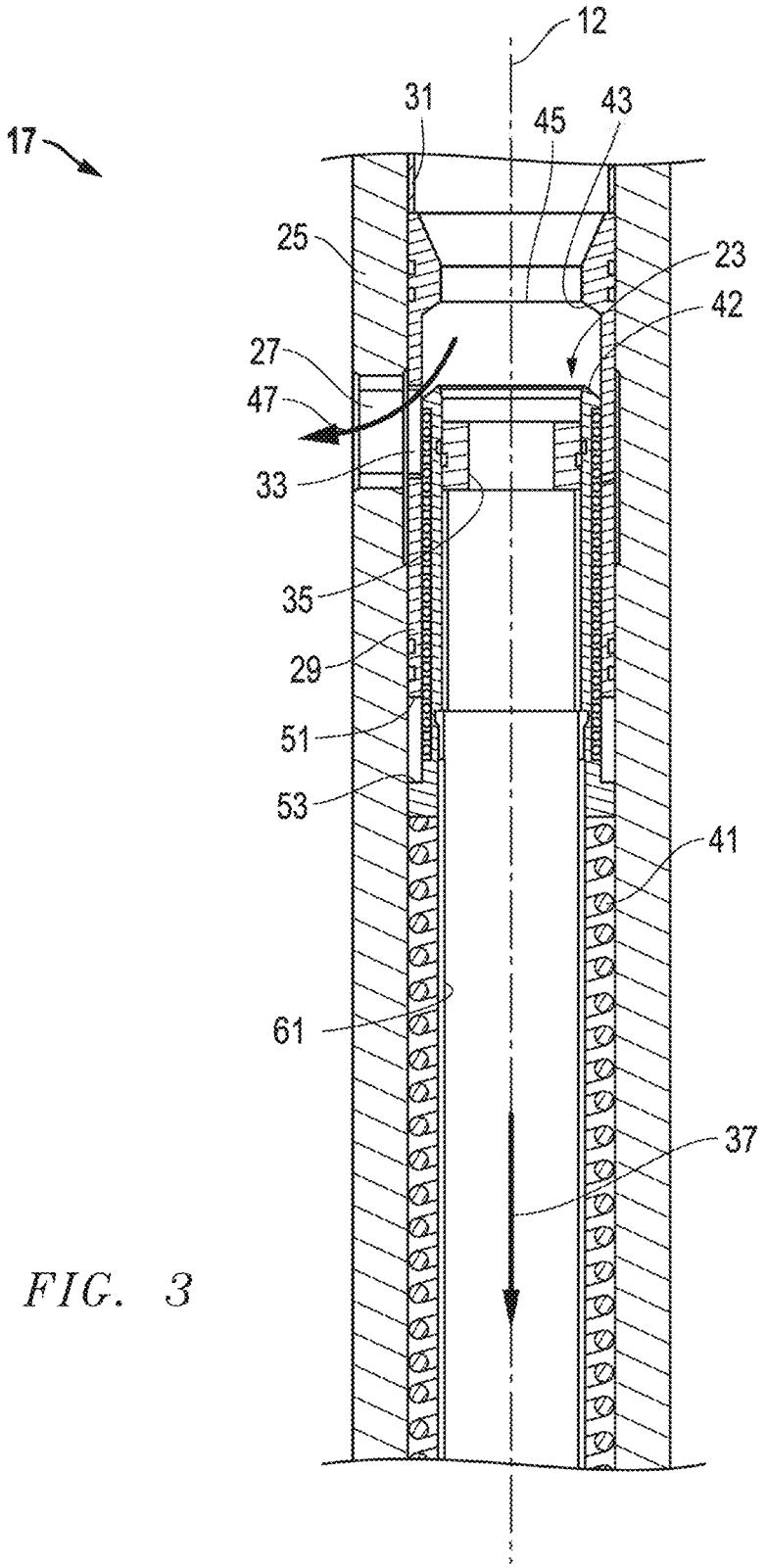
Figure 4:
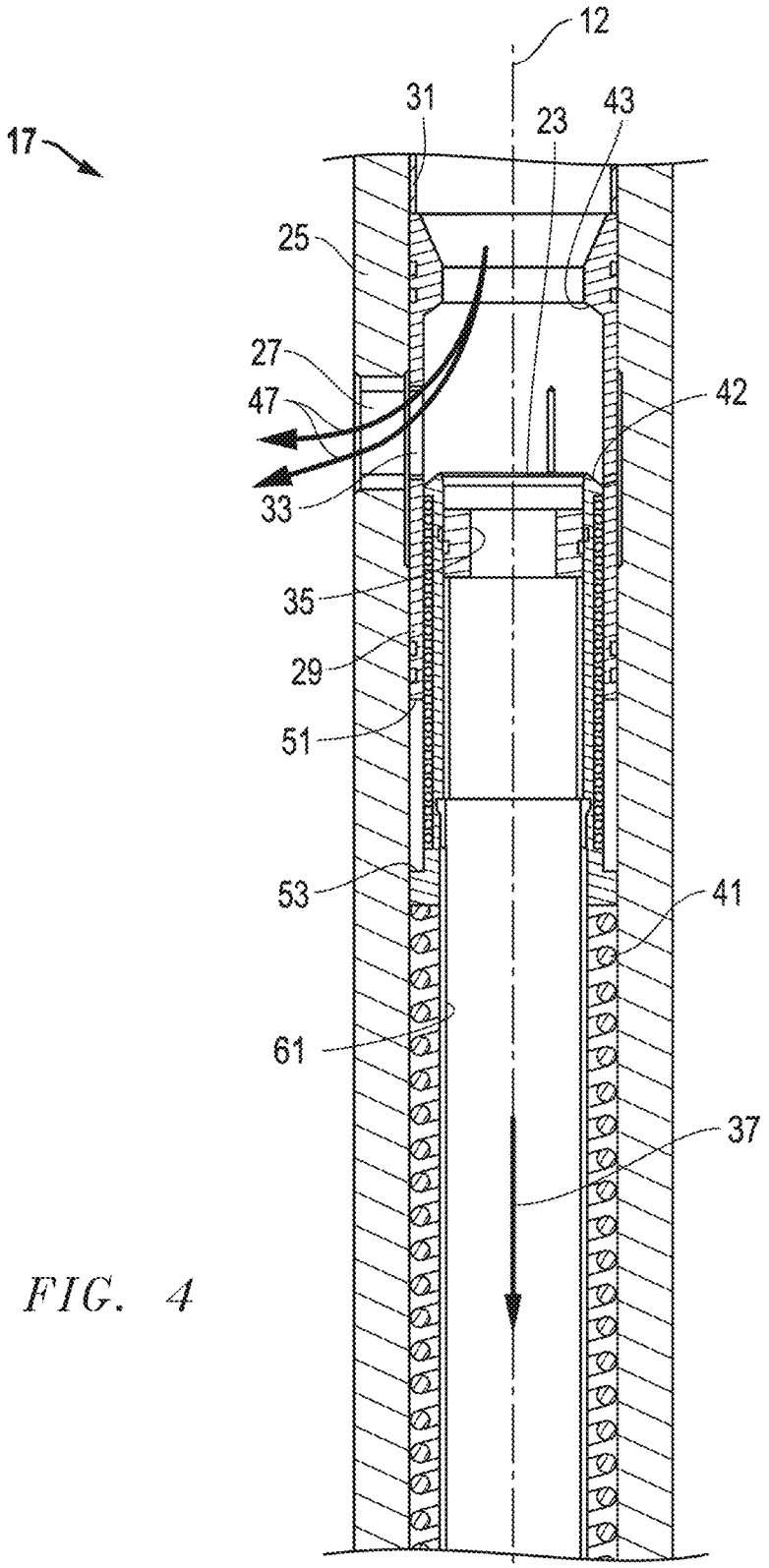

FIGS. 2-4 are enlarged views of fluid flow control tool 17. Each drawing depicts a piston 23 in a closed position (FIG. 2), a partially open position (FIG. 3) and a fully open position (FIG. 4). The fluid flow control tool 17 includes a housing 25 having an aperture 27 extending through a radial wall thereof. The aperture 27 may comprise one or more holes, slots, etc.

In the illustrated embodiment, a sleeve 29 that is stationary is mounted to the inner bore 31 of the housing 25. Sleeve 29 has a sleeve aperture 33 that corresponds with aperture 27 in housing 25. In some embodiments, the sleeve aperture 33 is smaller than and generally complementary in shape to the aperture 27. In some versions, the sleeve 29 and sleeve aperture 33 are configured to take the brunt of fluid erosion damage away from the housing 25 and aperture 27, such that aperture 27 may be beveled to reduce erosion. Sleeve 29 may be more readily replaced in fluid flow control tool 17 than housing 25. Sleeve 29 may be affixed to housing 25 such that it can be considered to be part of the housing 25, and to ensure alignment between apertures 27 and 33.

Embodiments of the piston 23 also comprise an inner axial orifice 35. As fluid 37 flows through the orifice 35 it may create a pressure drop and thus a downward force on piston 23. As long as the flow rate of fluid 37 is low enough, the resultant downward force by the fluid on piston 23 does not exceed the upward force of a spring 41. Under such conditions (FIG. 2), a shoulder 42 on the piston 23 will remain against an upper stop 43 located on an inner surface of sleeve 29. In addition or alternatively, the upward axial travel of piston 23 may be limited by landing a lower shoulder 53 of piston 23 on an upper shoulder 51 of sleeve 29.

FIG. 3 illustrates the same tool with the fluid flow rate increased such that the downward force that the fluid exerts on piston 23 is equivalent to or exceeds the upward force of spring 41. Under these conditions, the piston 23 moves axially downward to the "partially open" position shown in FIG. 3. The shoulder 42 on piston 23 is located axially below upper stop 43 on sleeve 29. As the top 45 of piston 23 moves below the top of the sleeve aperture 33 in sleeve 29 (and, thus, the top of aperture 27 in housing 25), a flow path begins to open such that some of the fluid 47 escapes out the radial side of the tool 17. Fluid 47 escapes to the wellbore annulus 49 (FIG. 1) located between the outer surface of downhole tool assembly 11 and the wellbore 10. The piston 23 finds an axial equilibrium between the downward pressure from fluid 37 through the orifice 35 and the upward force from spring 41. In some versions, the spring rate of the spring 41 may be selected such that the balancing force is substantially constant throughout the axial range of travel of the piston 23.

Figure 7:
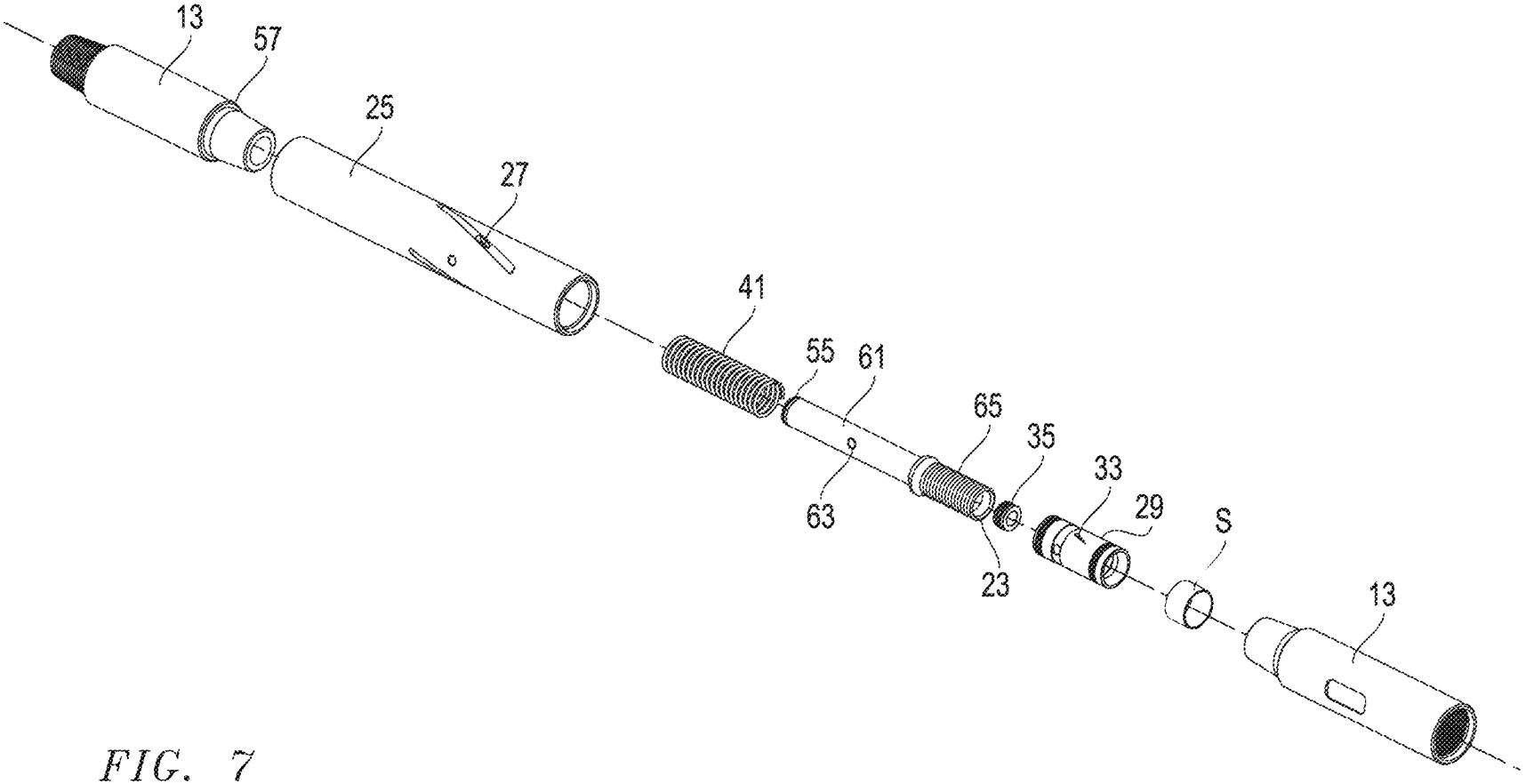
FIG. 7 is an exploded isometric view of an embodiment of a tool assembly.

FIG. 4 shows the piston 23 in a "fully open" position when it is subjected to an even larger fluid flow rate than that of FIG. 3. The fluid flow is divided between fluid 47 through the apertures 33, 27 in the side of the tool 17, and the fluid 37 flowing through the center of the tool 17. In the fully open position, the fluid flow completely overcomes the spring force of spring 41 and pushes piston 23 completely open. In this condition, fluid flow through apertures 33, 27 may be completely unobstructed by piston 23. In addition or alternatively, the downward axial travel of piston 23 may be limited by landing a lower shoulder 55 (FIG. 7) of piston 23 on an upper shoulder 57 of a sub 13.

In some embodiments, the apparatus or tool 17 may comprise a housing 25 having an axis 12, a radial wall with a bore 31 extending axially therethrough, and an aperture 27 formed in the radial wall. In some versions, the housing 25 may have has an axial length of about 3 feet to about 12 feet, and an outer diameter of about 3.5 inches to about 8 inches.

The aperture 27 may be in fluid communication with the bore 31. The aperture 27 in the housing 25 may comprise a plurality of apertures 27 formed circumferentially about the housing 25. In such embodiments, apertures 33 in sleeve 29 may be matched to and register with respective ones of the apertures 27.

Figure 5:
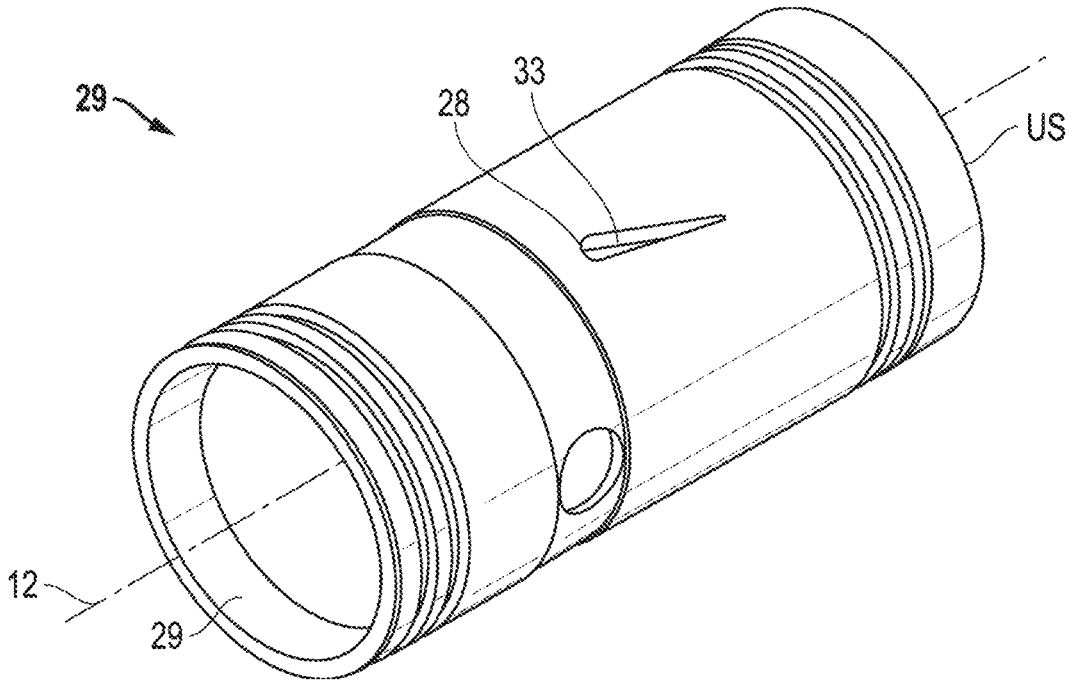
FIGS. 5 and 6 are isometric and side views, respectively, of an embodiment of a sleeve.
Figure 6:
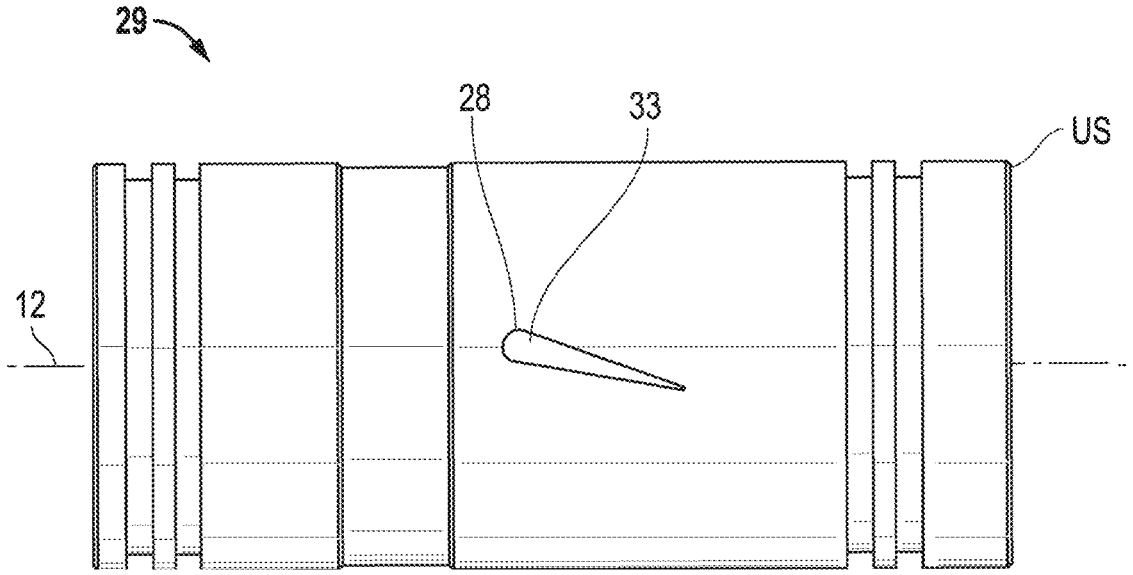

In some examples, the aperture 27 may comprise various shapes, such as an elongated slot, or as the teardrop shape shown in FIGS. 5 and 6. The aperture 27 may include an upper leading edge 28. In one example, the upper leading edge 28 is not greater than about 0.030 inches wide in a circumferential direction with respect to the axis 12. The aperture 27 may narrow or taper in width, such as toward a trailing edge thereof. The angle of taper may comprise, for example, not greater than about 15° from a narrowest end thereof, with respect to the axis 12. In addition, the aperture 27 may be skewed with respect to the axis 12, as shown.

Figure 12:
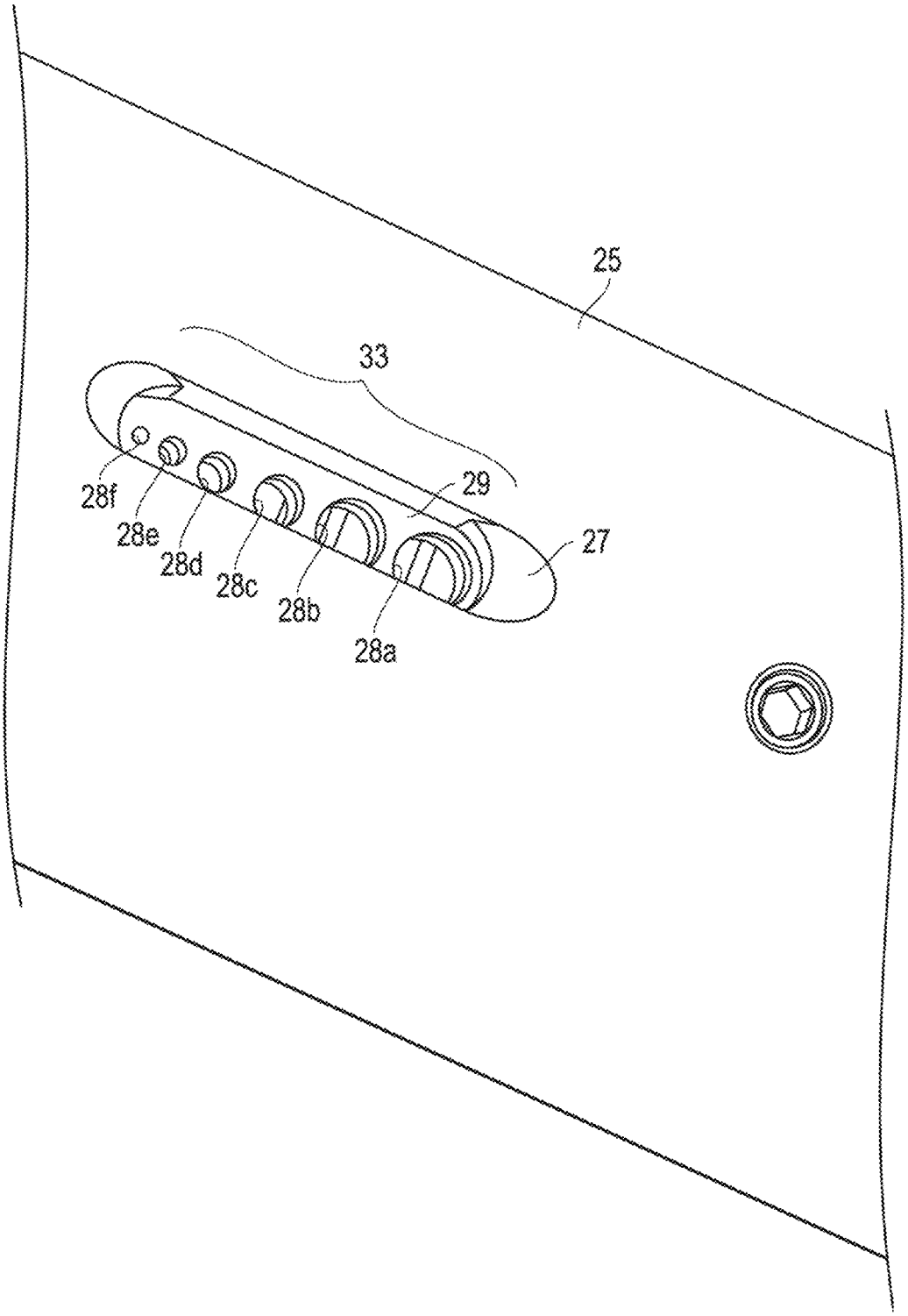
FIG. 12 is an enlarged isometric view of a portion of an alternate embodiment of a tool assembly.

In the embodiment of FIG. 12, each aperture 33 in sleeve 29 may comprise a plurality of holes. The plurality of holes used to form the aperture 33 may be configured in a selected appearance, such as a teardrop shape. For example, spaced-apart circular, and linearly aligned holes 28*a*-28*f* may be provided, rather than a single hole as previously described. Aperture 27 in housing 25 may still comprise a single elongated slot for such embodiments. Each aperture 27 in housing 25 may register with a set of the holes 28*a*-28*f*. Sets of a plurality of holes 28, rather than singular apertures 33 in the sleeve 29, may make the sleeve 29 more robust and less prone to cracking, thereby increasing its longevity.

In still other embodiments, each aperture 33 comprising a plurality of holes may be axially offset with respect to corresponding sizes of holes in other apertures 33. For example, the largest hole 28*a* in one aperture 33, may be axially offset by a select distance from another hole 28*a* in a different aperture 33, which itself may be axially offset by a further slight distance from a third hole 28*a* in a third aperture 33, etc. Such axial offsets may be repeated for other similarly sized holes in different apertures 33.

A piston 23 may be located inside the housing 25 and have an orifice 35 configured to permit axial fluid flow through the housing 25. A spring 41 may be located in the housing 25. The spring 41 may be configured to axially bias the piston 23 to a closed position (FIG. 2).

The piston 23 may be movable from the closed position wherein the piston 23 is configured to close the aperture 27 in the housing 25 to substantially block radial fluid flow therethrough when axial fluid flow 37 through the orifice 35 is insufficient to overcome a spring force of the spring 41. In an open position (which may include any position other than the closed position), the piston 23 may be configured to permit radial fluid flow 47 through the aperture 27 when axial fluid flow 37 through the orifice 35 is sufficient to overcome the spring force of the spring 41 and axially move the piston 23. In the open position, the piston 23 may be configured to permit substantially unobstructed radial fluid flow through the aperture 27.

Embodiments of the piston 23 may further comprise a partially open position, located between the closed position and the open position, wherein the piston 23 may be configured to reach a force equilibrium between the axial fluid flow 37 and the spring force such that the aperture 27 is only partially obstructed to radial fluid flow 47 by the piston 23.

The piston 23 may be configured to generate a pressure differential as fluid 37 flows through the orifice 35 so that the piston 23 pushes against the spring 41. The orifice 35 may be replaceable within a body of the piston 23, such that the body is configured to be reusable after the orifice 35 is replaced within the body. In some versions, the orifice 35 may have an inner diameter in a range of about 0.75 inches to about 1.5 inches. In addition, the piston 23 may be formed from a single material, or formed from at least two materials, one of which is harder (e.g., tungsten carbide) than the other (e.g., steel).

Embodiments of the apparatus 17 may further comprising a sleeve 29 located between the bore 31 of the housing 25 and the piston 23. The sleeve 29 may be stationary with respect to the housing 25. The piston 23 may be movable with respect to the sleeve 29 and housing 25. In some versions, both axial ends of the sleeve 29 may be sealed with respect to the bore 31 of housing 25.

The sleeve 29 may be consumable. The sleeve 29 may comprise a material that is harder than a material of the housing 25. For example, the housing may be some form of steel, and the material of sleeve 29 may comprise at least one of tungsten carbide, a ceramic, stabilized zirconia, alumina, and silica. Like the sleeve 29, the orifice 35 may be consumable and comprise a material that is harder than a material of the housing, and the orifice material comprises at least one of those same materials.

The piston 23 and the sleeve 29 may include shoulders 42, 43, respectively that abut each other in the closed position (FIG. 2). The shoulders 42, 43 may be axially spaced apart in the open position (FIG. 3 or 4). The shoulders 42, 43 may comprise at least one of upper shoulders and lower shoulders. In some versions, the piston 23 may have a range of axial travel in a range of about 1 inch to about 6 inches.

In addition, embodiments of the sleeve 29 may comprise a sleeve aperture 33 that registers with the aperture 27 in the housing 25. The sleeve aperture 33 may be smaller than the aperture 27 in the housing 25.

In some versions, at least some fluid leakage through the aperture 27 is permitted when the piston 23 is in the closed position. In other words, the aperture 27 is not necessarily sealed to stop fluid leaks when the piston is in the closed position. For example, up to about 5% of the fluid entering the apparatus 17 may be permitted to leak through the aperture 27 when the piston 23 is in the closed position.

The apparatus 17 may further comprise a labyrinth seal 65 (FIG. 7) between the housing 25 (or sleeve 29, if present) and the piston 23. The labyrinth seal 65 may be formed on an exterior of the piston 23, or could be on the inner surface of housing 25 or sleeve 29, if present.

Embodiments of the spring 41 may have a spring rate and may be configured to apply a force that is substantially constant over a range of axial movement of the piston. For example, the spring 41 may have a spring rate in a range of about 10 lb/in to about 70 lb/in. Examples of the spring 41 may comprise t least one of a coil spring, a Belleville spring stack and a polymer spring. In some embodiments, there is a frictional force between the housing 25 (or sleeve 29, if present) and the piston 23. The spring 41 may have a compression preload, such that the frictional force is less than about 5% of the compression preload.

The apparatus may further comprise a wash pipe 61 mounted to the piston 23. The spring 41 may be located between the bore 31 of the housing 25 and the wash pipe 61. Embodiments of the wash pipe 61 may be sealed to the piston 23 at one axial end and to the housing 25 (e.g., a sub 13 in FIG. 7) at the other axial end. The wash pipe 61 may comprise at least one hole 63 for communicating fluid to and from the spring 41. Pressure generated by fluid flow through the hole 63 is configured to act as a damper for the axial motion of the piston 23.

In some embodiments, the spring rate may be sufficiently low and the spring 41 is preloaded such that the force provided by the spring 41 is substantially constant over its operating range. In addition, the spring force may be sufficiently high such that at least about 95% of the resistance to downhole movement of the piston 23 may be provided by the spring 41 and not by unpredictable forces like friction.

In other embodiments of the tool 17, the amount of fluid flow through the center (i.e., orifice 35) of the tool 17 is substantially constant regardless of the fluid pressure, flow rate, fluid density, etc. The spring rate may be selected such that it is between about 10% and about 15% of the compression preload on the spring 41. Such a spring 41 may have a relaxed length that is about 2.5 times its compressed length. For example, a spring 41 having a spring rate of 25 lb/in may be compressed to provide a spring force or pre-load of 250 lbs in the compressed state (i.e., when the tool 17 is in the closed position). In order to move the piston 23 a distance of 1.5 inches, the spring force increases by 1.5 times the spring rate. In this example, 250 lbs+(1.5 in×25 lb/in)=282 lbs. Since the fluid pressure difference through the orifice 35 increases with the square of the flow rate, the axial fluid flow rate through the orifice 35 of the tool 17 can be considered to be substantially constant. The actual amount of increase in flow rate at the point where the piston moves to the point where the apertures are fully open can be calculated as increasing by a factor of the square root of the ratio of spring force on the piston in the open position to the spring force on the piston in the closed position, or:

$$\text{Flow(open)}=\text{Flow(closed)}\times\text{sqrt}(282/250)$$

$$\text{Flow(open)}=\text{Flow(closed)}\times 1.06.$$

So, even though the spring force increases by 13% (282/250) as the piston moves into an open position, the flow that is allowed to pass axially through the tool only increases by 6%.

Should the tool be configured such that the rate was 15% of the preload, the preceding calculation would be done as follows:

$$\text{Flow(open)}=\text{Flow(closed)}\times\text{sqrt}(306.25/250)$$

$$\text{Flow(open)}=\text{Flow(closed)}\times 1.10.$$

Therefore, in the case where the spring rate is configured to be 15% of the preload value, with a 1.5" axial movement of the piston the axial flow through the tool increases by 10%.

In other embodiments, a method of controlling fluid flow through a drill string may comprise operating the drill string to drill a hole in an earthen formation; pumping fluid through the drill string to a mud motor such that substantially all of the fluid is flows axially to the mud motor and substantially none of the fluid is radially diverted out of the drill string; and then increasing a flow rate of the fluid such that some of the fluid is radially diverted out of the drill string before reaching the mud motor, and a remainder of the fluid is flows axially to the mud motor. The valve opening may be proportional to the fluid flow rate. Pumping may comprise insufficient fluid pressure to overcome a mechanical force biasing a valve to a closed position. In some versions, increasing the flow rate may comprise opening a valve with fluid pressure that overcomes a mechanical force biasing the valve to a closed position. In other versions, increasing the flow rate may comprise variably controlling an amount of fluid that is radially diverted and the remainder of the fluid flowing axially to the mud motor.

Embodiments of a method of controlling fluid flow through a drill string may comprise operating a drill string to drill a hole in an earthen formation; pumping fluid through the drill string; closing a piston in the drill string to direct substantially all of the fluid to a mud motor; and then changing a parameter of the drill string such that the piston moves to an open position allowing at least a portion of the fluid to be diverted away from the mud motor.

When operating the tool, the impact of tool 17 that will be noticed at the surface of the well is that once the flow rate is increased to the point that the tool opens, the stand pipe pressure (or surface operating pressure) will increase more slowly with any further flow rate increases. Thus, once the piston in the tool begins to open (i.e., from one of the partially open positions to the fully open position), the fluid pressure does not substantially increase even with an increase in fluid flow rate. This is due to the fact that pressure of the fluid at the surface is a function of the drilling fluid flow rate through the surface piping, the drill pipe, and the bottom hole assembly (BHA, or MWD, mud motor, drill bit, etc.). As fluid flow opens the tool, an increasing amount of fluid bypasses the BHA through the radial aperture. Thus, even though the fluid flow rate may increase, the fluid pressure through the BHA is substantially constant. Increases in fluid pressure can originate from more fluid flow through the surface piping and the drill string.

For example, the tool 17 may be configured with the following constants. The ID of most of the tool components is about 2 inches, which will be the number used in flow calculations for Bernoulli's equation. The piston/orifice combination may be considered a single part for these purposes. Further, for the purposes of calculation it can be thought of as a toroid (donut) shape with a cross-sectional area that is a function of its ID and OD and will, in conjunction with the orifice pressure drop (delta P), determine the downward force that the piston applies to the spring. The OD of the piston may be 3 inches. The ID of the orifice may be determined based on flow rate.

In this example, the spring has a spring rate of 25 lb/in and is compressed (preloaded) in the closed state such that it applies a force of 200 lb on the piston. The spring may be compressed 8 inches for this example. Incidentally, and not considered in this calculation, the force on the piston increases slightly as it moves downwards. If the piston moves down by one inch the force will increase by 25 lbs to 225 lbs.

In one example, the tool may be set up so that only 250 gpm of fluid will go axially through the tool and that any increase in flow rate will be allowed to exit through the radial apertures. A flow rate of 250 gallons per minute is equivalent to 962.5 cubic inches per second. In this example, the density of the fluid flowing through the tool can be about 10 ppg (pounds per gallon), or 6.9 slugs/cubic ft.

This may comprise an iterative calculation (where the orifice diameter determines the pressure drop at a given flow rate, but it also can determine the cross sectional area over which the pressure is applied. Thus, the calculation could be performed many times. However, the ID does not drastically affect the area as much as it affects pressure drop. Accordingly, a good starting estimate for orifice size is sufficient to bring the calculation to a satisfactory conclusion.

For example, if the orifice ID may be estimated at 1.2 inches. If the piston has an OD of 3.00 inches, then the cross sectional area is:

A=pi*((Piston OD/2)squared−(Orifice ID/2) squared)=5.93 sqin. This is the area that the delta P acts on to push against the spring.

With this area, the pressure drop (delta P) that will start to move the spring is:

deltaP=preload force/cross sectional area.

So, delta P=200 lb/5.93 sqin=33.7 psi. Or, 4853 lbs/square foot.

The velocity of the fluid may be determined as it goes through the 2" ID section of the tool. If the design goal is 250 gpm, velocity may be calculated as V=Q/A where Q is the volume flow rate. For consistent units, the calculation in feet per second is: for flow rate 962.5 cubic inches per second, and area is 3.14 sq in, the inlet velocity is 306.4 in/second or 25.5 ft/second.

Bernoulli's equation for pressure drop across an orifice is:

Delta *P*=(density×(orifice fluid velocity)squared)/2−density×(inlet fluid velocity)squared)/2

The delta P and inlet velocity are known, and the equation may be configured for orifice velocity.

Orifice Velocity=sqrt((2*delta *P*/density)+(inlet fluid velocity)squared)

Thus, Orifice velocity=sqrt((2*4853/(6.9))+(25.4) squared)

Orifice Velocity=45.3 ft/s

Converted to in/s, velocity is 543.6 in/s

And back calculating an orifice area, A=Q/V, so A=962.5/543.6=1.77 sqin.

And finally, the orifice diameter becomes sqrt(4*Area/pi)=sqrt(4*1.77/3.14159)

Diameter=1.50 inches.

This calculation provides an orifice diameter of 1.50 inches gives a pressure drop of 33.7 psi at a flow rate of 250 gallons per minute. This calculation is slightly different from the original estimate of 1.20 inches. The area difference that this equates to is 5.3 inches squared as opposed to the original estimate of 5.93 inches, which is a difference of 0.63 square inches or 10%. The formula may be recalculated with this new estimate to yield a more precise value. With a new estimate of a 1.5 inch orifice, recalculating the numbers provides an orifice value of 1.48 inches. A value of 1.48 inches is sufficiently close to the previous iteration value of 1.50 that the calculation can be considered to be complete.

Embodiments of the tool described herein solve the problems described above with a piston assembly that moderates the amount of flow that exits the tool. The holes in the sides of the tool can be partially closed to change their size. As the holes are made smaller, a larger portion of the flow is directed downward through the motor. As the holes are enlarged, more of the flow is directed radially outward to bypass the motor and yet still aid in the hole cleaning process. The moderation of hole size can be done very quickly, typically in a fraction of a second. Rapid hole size selection addresses issues such as motor stalls and stick-slip, which can occur and can be resolved very quickly.

In some embodiments, the piston assembly comprises a sleeve that slides axially to open or close one or more holes in the tool. The holes may comprise a variety of shapes, such as axially elongated shapes. An orifice is attached to the sleeve to generate a pressure difference across the orifice that depends on the amount of fluid flow. Pushing the sleeve and orifice upwards is a spring with a spring rate that is as low as is reasonable given the other mechanical constraints of the tool. The spring may be preloaded such that a high amount of force is required to make the sleeve initially move from the seated position, but relatively low additional force may be required to push the sleeve down to its fully open position. Thus, the position of the piston may be correlated with the amount of fluid flow that exits through the side of the tool, rather than the amount of flow that is directed down hole to the motor. Accordingly, the spring may have a relatively constant force over its range of travel. The downward force from the fluid is generated by flow through the orifice. Since the downward force balances with the upward spring force, the flow through the orifice may remain relatively constant as well. Fluid flow that is in excess of an amount required to push the sleeve down may be directed out the side of the tool.

A motor "stalls" when its rotor stops turning and fluid flow is backstopped such that the fluid stops flowing through the motor. With the embodiments described herein, motor stalls are avoided since pressure drops through the orifice allow the sleeve to move upward to close the radial holes and direct more fluid down through the orifice to the motor where it is needed to correct the stall.

An embodiment of a tool described herein solves the previously described problems by including a valve mechanism that moderates the amount of flow that exits the tool. The holes in the side of the tool are designed so that they can be partially covered to change their size. As the holes are made smaller, a larger portion of the flow is directed downward through the tool to the motor. As the holes are enlarged, a more significant portion of the flow is directed out to the annulus to bypass the motor yet aid in the bottom hole cleaning process. The moderation of the size of these holes may be done quickly, typically in much less than one second, to avoid motor stalls and stick-slip.

In some versions, the valve mechanism is a sleeve that slides down to open holes in the tool that are axially elongated. Attached to this sleeve is an orifice that generates a pressure difference across it that depends on the amount of flow. Pushing the sleeve and orifice upwards is a spring with a rate that is as low as is reasonable given the other mechanical constraints of the tool. This spring is preloaded such that a high amount of force is required to make the sleeve move from the seated position but relatively little additional force pushes the sleeve all the way down into it fully open position. In this way the position of the valve is correlated with the amount of flow that exits through the side of the tool and not with the amount of flow that is directed down parts. That is, the spring can have a relatively constant force over its range of travel. And since the downwards force that balances the spring is generated by flow through the orifice, that means that the flow through the orifice will stay relatively constant as well. Any amount of flow that is higher than the flow required to push the sleeve down to the point where a slot becomes open is directed out the side of the tool.

The spring force that works to push the piston up against the flow and pressure reduce force, and a damping device or "dash pot" that works to provide a force that is opposite of the direction of movement may be used. Including a damping device slows the movement of the main sleeve or piston to prevent the sleeve from building up enough momentum that it significantly moves past its point of equilibrium in the event of a change of drilling conditions (either flow or back pressure). Without a damping device and especially if the slot is not sufficiently narrow the piston may overshoot the equilibrium point at which point the hydraulic and spring forces would be reversed and the piston would move back in the other direction, causing the valve to oscillate open and shut rather than to stay at a stable position, as is desired.

It is desirable to keep any downhole device, and the damping device or system in particular, as simple as possible to extend longevity and reduce the chance of failure. Additionally, friction does make an adequate means of damping because of the difference between static and dynamic friction. As static friction is generally larger than dynamic friction, the largest damping force would occur when the device is not moving, which is when the least amount of damping force is required, and vice versa. A much better means of damping is a viscous damping system where fluid is forced to flow between two defined volumes as a piston moves. That way, the faster the piston moves, the faster fluid is forced to flow to equalize the volumes. The faster that fluid moves through a small orifice separating the two volumes the larger the pressure drop across that orifice. The larger that pressure drop is, the larger the hydraulic force on the piston, which will always be opposite to the direction of movement.

Since the damping force need not be precisely defined and that it needs only to be within a given range, there is no need to know exactly the properties of the fluid that move between the two volumes. Because of this it is possible to use whatever drilling fluid is being used to drill the well as the viscous damping fluid. This allows the design to become quite simple in that there is no need for an oil-filled section, nor the further necessity to have it pressure and temperature compensated to allow for downhole use. Substantially any volume filled with a non-compressible fluid and used downhole must be allowed to change volume to allow for compression and thermal expansion. With the necessity for an oil-filled section removed, the housing of the damping unit can be completely open to the drilling fluid. The bypass orifice or means for fluid to move past the piston can be a quasi-seal around the outside of the piston. For example, a metal piston ring is used. The piston ring allows fluid to move past it as long as the fluid is moving very slowly. A piston ring will not allow high rates of fluid to move past it.

The dash pot described herein may comprise two main parts. A housing that is generally a hollow cylinder and defines a volume that a piston can move axially within., may be mounted to the main body or housing of the valve sub. A piston which moves within that housing is mounted to the valve sleeve or piston and moves axially as the main piston moves. The volume defined on each side of the damper piston changes in size as the main piston moves, thereby changing volume, necessitating flow into or out of that volume, and providing a damping force for the main piston.

Referring now to FIGS. 8-11, an alternate embodiment of a tool 100 is depicted with a damper at its lower end. Tool 100 many comprise any combination of the features and elements described herein for the other embodiments.

Figure 8:
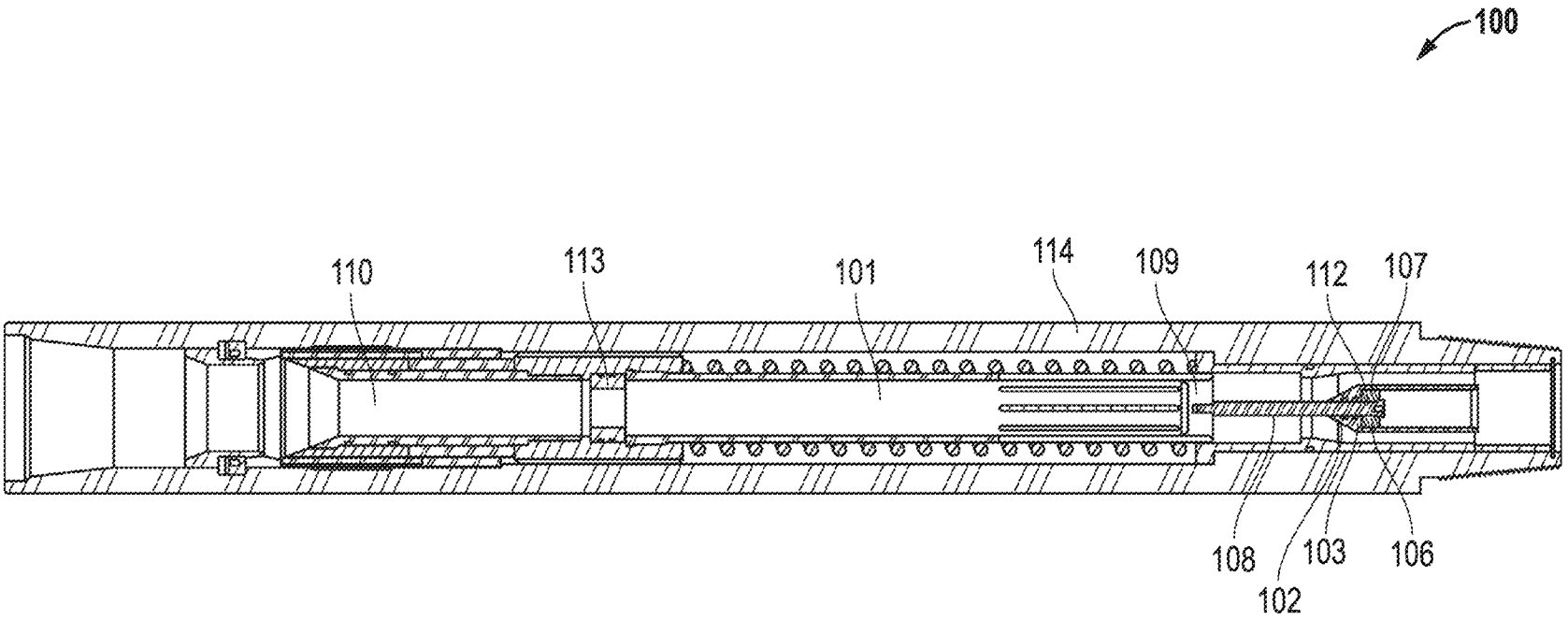
FIG. 8 is a sectional side view of an alternate embodiment of a tool assembly with an axial damper in a closed position.
Figure 10:
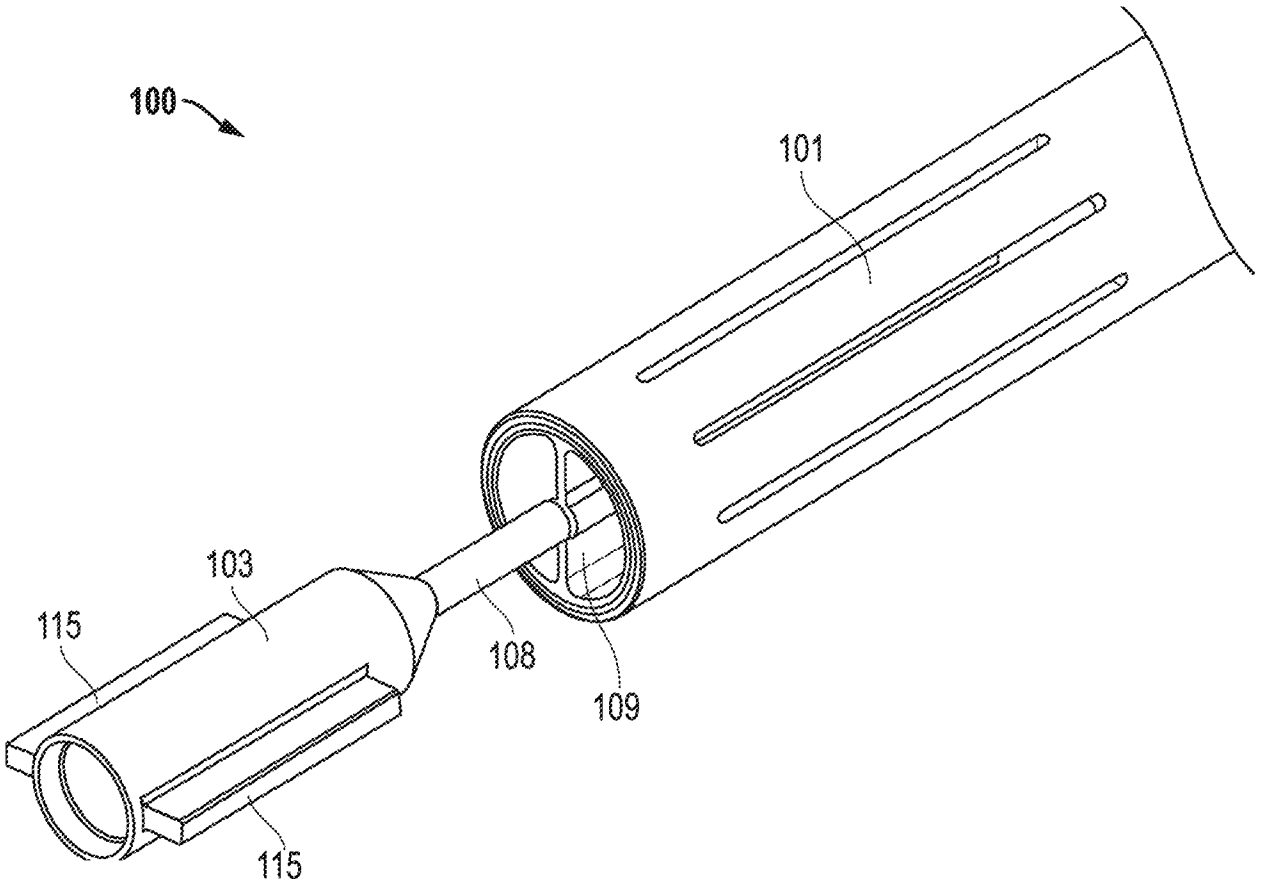
FIG. 10 is an isometric view of a lower portion of the embodiment of FIG. 8.
Figure 11:
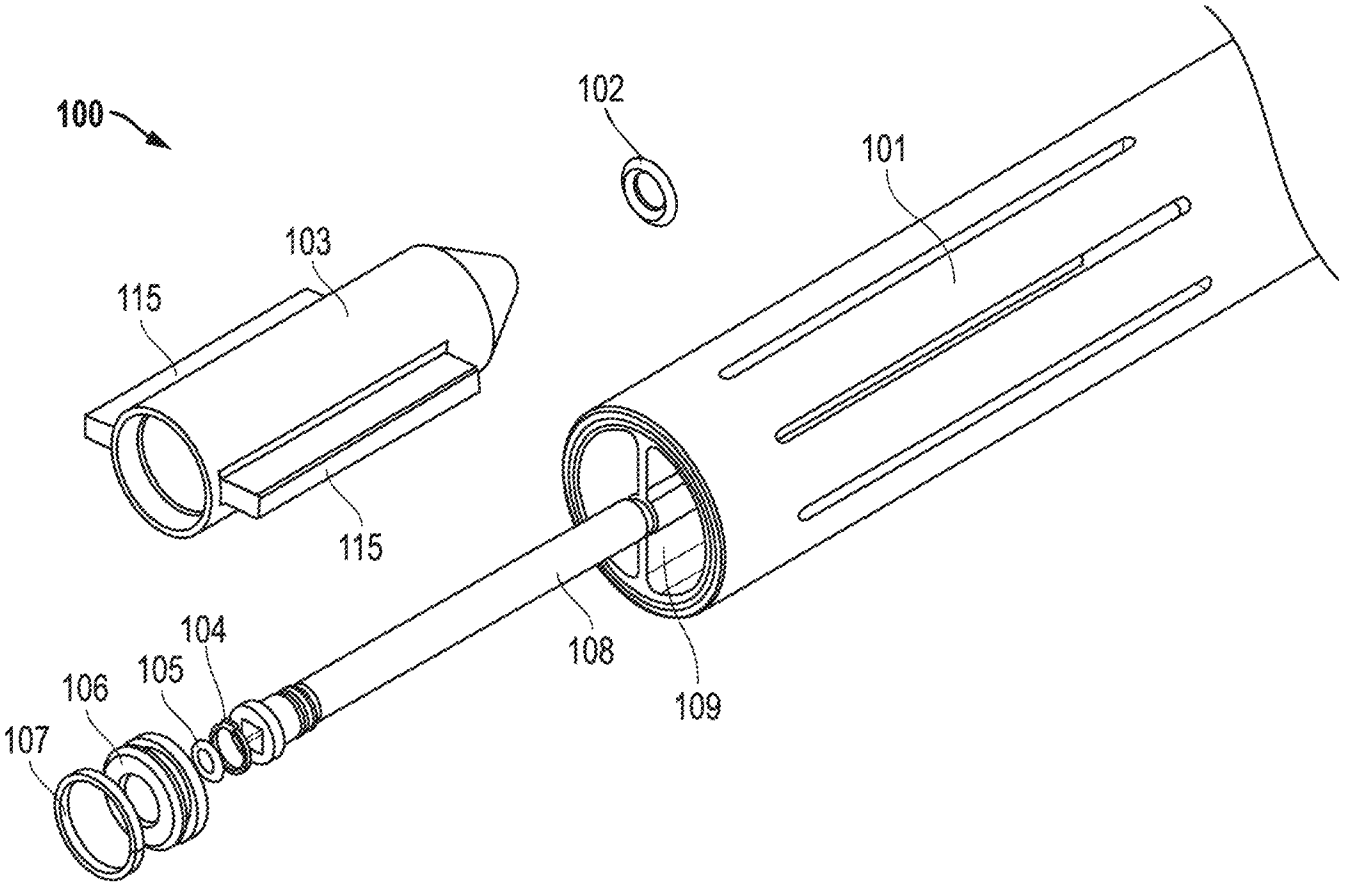
FIG. 11 is an exploded isometric view of the lower portion of FIG. 10.

FIG. 8 shows the tool 100 in a "closed" position. The main piston or sleeve 110 is in the "up" position. A damping housing 103 is mounted to a main body 114 through the use of webbing 115 (FIGS. 10 and 11). The damping piston 106 is connected to the main piston sleeve 110 by a wash tube 101, and a damping piston shaft 108 therebetween.

Figure 9:
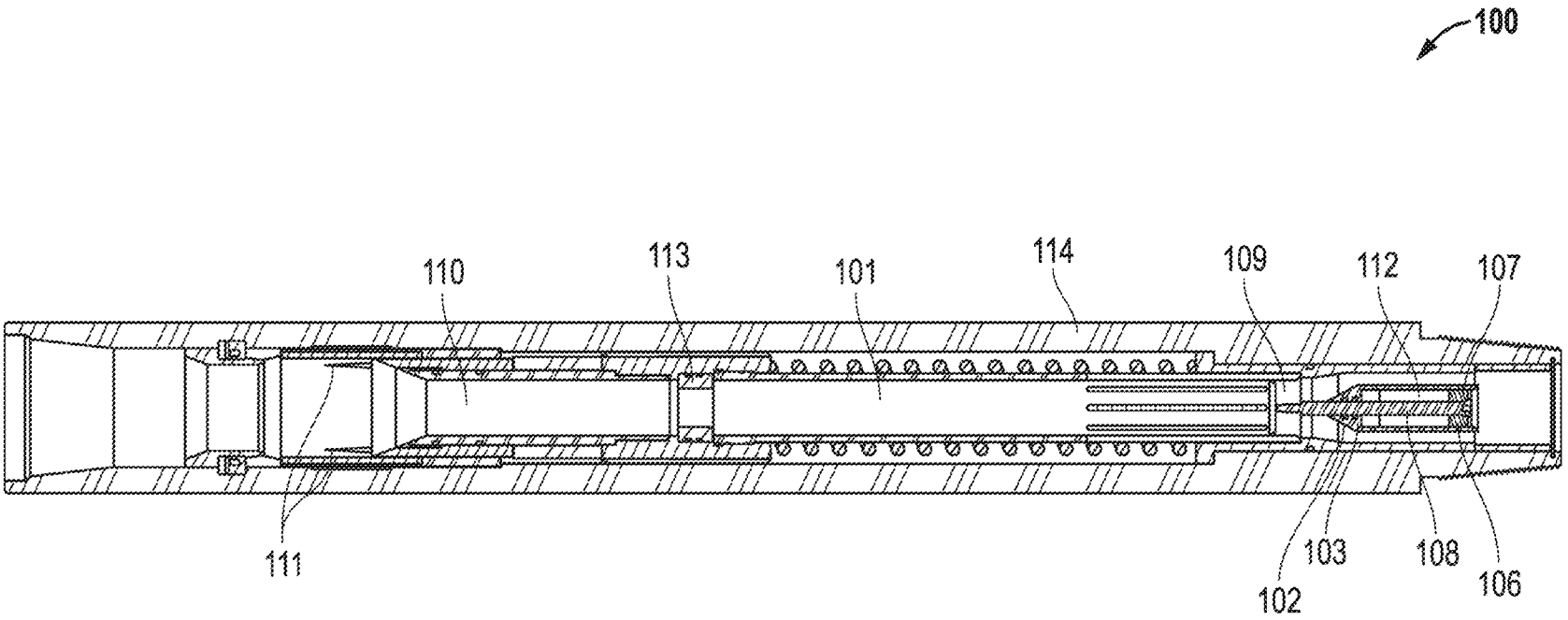
FIG. 9 is a sectional side view of the embodiment of FIG. 8 with the axial damper in an open position.

FIG. 9 shows the tool in an "open" position. With the main piston 110 moved down (for reasons described elsewhere herein), the teardrop-shaped holes 111 (also described elsewhere herein) are exposed in the side of the main body 114. Holes 111 permit some of the fluid flow to exit to the well bore annulus. Accordingly, there is a reduced amount of fluid flow down through the main orifice 113. In this way, the pressure drop across the orifice 113 can balance the spring force and so that the main piston 110 moves to a position where equilibrium is maintained.

In operation, when the tool 100 is in the open position, the volume 112 within damping housing 103 defined between the damping piston 106 and the interior of the damping housing 103 is larger than it is when the tool is closed (FIG. 8). As the main piston 110 opens or closes and volume 112 changes in size, fluid must enter or exit the volume 112 by flowing past the piston ring quasi-seal 107, which seals against the inner surface of the damper housing 103. Using a piston ring 106 instead of a more conventional elastomer seal coupled with a small hole in the damping piston permits greater simplicity and improved reliability.

In some embodiments of the tool 100, the wash tube 101 protects the spring 121 and couples the main piston 110 to the damping piston 106. The damping piston 106 has a shaft seal 102 within the damper housing 103. A snap ring 104 secures the damper piston 106 to the damper piston shaft 108. Another seal 105 is located between the damper piston 106 and the damper piston shaft 108. The damper piston 106 also has a piston ring quasi-seal 107 that engages the inner surface of the damper housing 103, while permitting limited fluid flow past it. A damper piston shaft connection spider 109 further supports damper piston shaft 108, while readily allowing fluid flow through wash tube 101.

Still other embodiments may include one or more of the following items:

Item 1. An apparatus for drilling, comprising:

a housing having an axis, an entrance at one axial end and an exit at an opposite axial end, a radial opening in a side of the housing extending from an interior of the housing to an exterior of the housing;

a sleeve slidably mounted in the interior of the housing that closes or partially closes the radial opening in the housing as the sleeve moves axially upward toward the entrance;

a spring mounted in the housing that biases the sleeve toward the entrance, and an axial aperture in the sleeve is configured to generate a pressure differential as fluid flows through the axial aperture to push the sleeve down against the spring; and a viscous damping device coupled between the sleeve and the housing for damping axial motion of the sleeve in both axial directions.

Item 2. The apparatus of any of these items, wherein the viscous damping device comprises a damper housing and a piston configured to move axially relative to each other in response to axial movement of the sleeve relative to the housing.

Item 3. The apparatus of any of these items, wherein the piston is connected to the sleeve and the damper housing is stationary.

Item 4. The apparatus of any of these items, wherein the damper housing is connected to the sleeve and the piston is stationary.

Item 5. The apparatus of any of these items, further comprising a seal between the piston and the damper housing.

Item 6. The apparatus of any of these items, wherein the piston and damper housing are configured to allow fluid communication between an outer diameter of the piston and an inner diameter of the damper housing as the piston moves in both axial directions.

Item 7. The apparatus of any of these items, further comprising a quasi-seal between the outer diameter of the piston and the inner diameter of the damper housing to permit fluid communication therethrough.

Item 8. The apparatus of any of these items, further comprising a damper piston shaft connecting the piston to the sleeve.

Item 9. The apparatus of any of these items, further comprising a wash tube coupled between the sleeve and the piston, the wash tube having a connection spider for coupling to a piston shaft of the piston, and the damper housing comprises a tubular body having damper webbing for coupling the damper to the housing, and both the connection spider and the damper webbing readily permit axial fluid flow through the wash tube and the around the damper housing, respectively.

Item 10. The apparatus of any of these items, where a fluid that fills the damping housing is drilling fluid used for drilling operations, such that the viscous damping device operates exclusively with the drilling fluid rather than a separate hydraulic fluid.

Item 11. The apparatus of any of these items, wherein the radial opening in the housing, comprises a plurality of elongated slots, the aperture in the sleeve comprises a plurality of apertures in the sleeve, and each aperture comprises a plurality of linearly aligned holes that selectively register with respective ones of the elongated slots.

Item 12. The apparatus of any of these items, wherein the plurality of linearly aligned holes are circular, differ in size from each other, and are configured in a teardrop shape.

Item 13. The apparatus of any of these items, wherein each aperture is axially offset with respect to other ones of the apertures.

Item 14. A method of controlling fluid flow through a drill string, comprising:

operating the drill string to drill a hole in an earthen formation;

pumping fluid through the drill string to a mud motor, such that substantially all of the fluid flows axially to the mud motor and substantially none of the fluid is radially diverted out of the drill string; then increasing a flow rate of the fluid such that some of the fluid is radially diverted out of the drill string by a valve before reaching the mud motor, and a remainder of the fluid flows axially to the mud motor; and viscously damping the valve in both axial directions with an axial damper that is responsive to the axial fluid flow.

Item 15. A method of controlling fluid flow through a drill string, comprising:

operating a drill string to drill a hole in an earthen formation;

pumping fluid through the drill string;

closing a piston in the drill string to direct substantially all of the fluid to a mud motor; then changing a parameter of the drill string such that the piston moves axially to an open position allowing at least a portion of the fluid to be diverted away from the mud motor; and viscously damping the piston in both axial directions with an axial damper that is responsive to the axial fluid flow.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An apparatus for drilling, comprising:

a housing having an axis, an entrance at one axial end and an exit at an opposite axial end, a radial opening in a side of the housing extending from an interior of the housing to an exterior of the housing;

a sleeve slidably mounted in the interior of the housing that closes or partially closes the radial opening in the housing as the sleeve moves axially upward toward the entrance;

a spring mounted in the housing that biases the sleeve toward the entrance, and an axial aperture in the sleeve is configured to generate a pressure differential as fluid flows through the axial aperture to push the sleeve down against the spring; and a viscous damping device coupled between the sleeve and the housing for damping axial motion of the sleeve in both axial directions;

wherein the radial opening in the housing comprises a plurality of elongated slots, and the apparatus further comprises a stationary sleeve mounted to the interior of the housing, the stationary sleeve having a plurality of apertures, each aperture of the stationary sleeve comprising a respective plurality of holes aligned with a respective one of the elongated slots; and wherein each aperture is axially offset with respect to other ones of the apertures.

2. The apparatus of claim 1, wherein the viscous damping device comprises a damper housing and a piston configured to move axially relative to each other in response to axial movement of the sleeve relative to the housing.

3. The apparatus of claim 2, further comprising a seal between the piston and the damper housing.

4. The apparatus of claim 2, wherein the piston and damper housing are configured to allow fluid communication between an outer diameter of the piston and an inner diameter of the damper housing as the piston moves in both axial directions relative to the damper housing.

5. The apparatus of claim 4, further comprising a quasi-seal between the outer diameter of the piston and the inner diameter of the damper housing to permit fluid communication therethrough.

6. The apparatus of claim 2, wherein a fluid that fills the damper housing is drilling fluid used for drilling operations, such that the viscous damping device operates exclusively with the drilling fluid rather than a separate hydraulic fluid.

7. The apparatus of claim 1 wherein the sleeve has a closed position within the interior of the housing which permits up to about 5% of the fluid entering the apparatus to leak through the radial opening.

8. The apparatus of claim 1 wherein the sleeve has an open position within the interior of the housing which permits substantially unobstructed flow through the radial opening.

9. An apparatus for drilling, comprising:

a housing having an axis, an entrance at one axial end and an exit at an opposite axial end, a radial opening in a side of the housing extending from an interior of the housing to an exterior of the housing;

a sleeve slidably mounted in the interior of the housing that closes or partially closes the radial opening in the housing as the sleeve moves axially upward toward the entrance;

a spring mounted in the housing that biases the sleeve toward the entrance, and an axial aperture in the sleeve is configured to generate a pressure differential as fluid flows through the axial aperture to push the sleeve down against the spring; and a viscous damping device coupled between the sleeve and the housing for damping axial motion of the sleeve in both axial directions;

wherein the radial opening in the housing comprises a plurality of elongated slots, and the apparatus further comprises a stationary sleeve mounted to the interior of the housing, the stationary sleeve having a plurality of apertures, each aperture of the stationary sleeve comprising a respective plurality of holes aligned with a respective one of the elongated slots; and wherein the holes of a given plurality of holes are linearly aligned, circular, differ in size from each other, and are configured in a teardrop shape.

10. The apparatus of claim 9, wherein the viscous damping device comprises a damper housing and a piston configured to move axially relative to each other in response to axial movement of the sleeve relative to the housing.

11. The apparatus of claim 10, further comprising a seal between the piston and the damper housing.

12. The apparatus of claim 10, wherein the piston and damper housing are configured to allow fluid communication between an outer diameter of the piston and an inner diameter of the damper housing as the piston moves in both axial directions relative to the damper housing.

13. The apparatus of claim 12, further comprising a quasi-seal between the outer diameter of the piston and the inner diameter of the damper housing to permit fluid communication therethrough.

14. The apparatus of claim 10, wherein a fluid that fills the damper housing is drilling fluid used for drilling operations, such that the viscous damping device operates exclusively with the drilling fluid rather than a separate hydraulic fluid.

15. The apparatus of claim 9 wherein the sleeve has a closed position within the interior of the housing which permits up to about 5% of the fluid entering the apparatus to leak through the radial opening.

16. The apparatus of claim 9 wherein the sleeve has an open position within the interior of the housing which permits substantially unobstructed flow through the radial opening.

17. The apparatus of claim 9, wherein each aperture is axially offset with respect to other ones of the apertures.

* * * * *